US008196591B2

(12) United States Patent
Lee et al.

(10) Patent No.: US 8,196,591 B2
(45) Date of Patent: Jun. 12, 2012

(54) ARTIFICIAL EYELASH AND METHOD FOR APPLYING SAME

(75) Inventors: Jaenee Lee, Port Washington, NY (US); Kyu Han, Port Washington, NY (US)

(73) Assignee: Kiss Nail Products, Inc., Port Washington, NY (US)

( * ) Notice: Subject to any disclaimer, the term of this patent is extended or adjusted under 35 U.S.C. 154(b) by 155 days.

(21) Appl. No.: 12/587,079

(22) Filed: Oct. 1, 2009

(65) Prior Publication Data

US 2011/0079236 A1 Apr. 7, 2011

(51) Int. Cl.
*A41G 3/00* (2006.01)
*A41G 5/00* (2006.01)

(52) U.S. Cl. ..... 132/53; 132/201

(58) Field of Classification Search ..... 132/200, 132/201, 216, 218, 320, 53–56, 212; 446/393, 446/394; 206/581, 823; D28/4, 93, 99; 15/159.1; *A45D 7/00, 40/26; A41G 3/00, 5/00*
See application file for complete search history.

(56) References Cited

U.S. PATENT DOCUMENTS

| | | | | |
|---|---|---|---|---|
| 1,897,747 | A * | 2/1933 | Birk | 132/53 |
| 2,651,310 | A * | 9/1953 | Selson | 132/274 |
| 3,447,542 | A * | 6/1969 | McCullough | 132/53 |
| 3,456,657 | A * | 7/1969 | Smith | 132/53 |
| 3,868,959 | A * | 3/1975 | Koh | 132/53 |
| 3,880,175 | A * | 4/1975 | Hosokawa | 132/53 |
| 4,018,336 | A | 4/1977 | Aylott | |
| 4,029,111 | A * | 6/1977 | Barton | 132/53 |
| 4,299,242 | A * | 11/1981 | Choe | 132/53 |
| 7,032,602 | B2 | 4/2006 | Chang | |
| 7,306,690 | B2 | 12/2007 | Hodsdon et al. | |
| 2002/0056465 | A1 * | 5/2002 | Shin | 132/53 |
| 2003/0000540 | A1 * | 1/2003 | Makino et al. | 132/201 |
| 2003/0005941 | A1 * | 1/2003 | Iosilevich | 132/53 |
| 2005/0051186 | A1 * | 3/2005 | Smith et al. | 132/54 |
| 2007/0227550 | A1 * | 10/2007 | Merszei | 132/53 |
| 2008/0178902 | A1 * | 7/2008 | Moeszinger | 132/273 |
| 2009/0217938 | A1 * | 9/2009 | Rabe et al. | 132/216 |
| 2010/0154815 | A1 * | 6/2010 | Chang | 132/201 |
| 2011/0209719 | A1 * | 9/2011 | Anzivino | 132/53 |

FOREIGN PATENT DOCUMENTS

| | | |
|---|---|---|
| JP | 2000-27018 | 1/2000 |
| RU | 2 095 010 | 11/1997 |
| SU | 300162 | 5/1971 |
| WO | WO 2008/071505 | * 6/2008 |

OTHER PUBLICATIONS

Ardell® Fashion Lashes Starter Kit, Item #60099; American International Industries, Los Angeles CA 90040.

* cited by examiner

*Primary Examiner* — Todd Manahan
*Assistant Examiner* — Tatiana Nobrega
(74) *Attorney, Agent, or Firm* — The Farrell Law Firm, P.C.

(57) ABSTRACT

An artificial eyelash assembly includes a base strand having a first end and a second end opposite the first end and a plurality of hairs. A first loop is disposed proximate the first end of the base strand and a second loop is disposed proximate the second end of the base strand. A first flexible member is coupled to the first loop and a second flexible member is coupled to the second loop.

7 Claims, 8 Drawing Sheets

ARTIFICIAL EYELASH AND METHOD FOR APPLYING SAME

BACKGROUND OF THE INVENTION

1. Field of the Invention

The invention relates to an artificial eyelash, an artificial eyelash assembly and a method for applying an artificial eyelash to an eyelid.

2. The Prior Art.

It is known to adorn a person's eyes with artificial eyelashes which are secured to a wearer's eyelid. In a typical application, the artificial eyelash may be cut to length, if necessary. An adhesive, such as a latex-based adhesive is applied to the artificial eyelash. The artificial eyelash is gripped with the wearer's fingers, bent to a selected curvature and manually placed by the wearer on the wearer's eyelid.

As an alternative to gripping the artificial eyelash directly with a user's fingers, a number of applicator devices for applying an artificial eyelash to an eyelid are known. These known applicators include a rigid plastic clamshell-style applicator which provides a gripping contact along the entire or substantially the entire length of the artificial eyelash. Additionally, U.S. Pat. No. 4,018,336 to Aylott shows a plastic applicator for an artificial eyelash. The applicator has a handle and an arcuate support portion to which a convex side of the artificial eyelash is secured.

An effective application requires the proper degree of tension and curvature, as well as accurate placement of the artificial eyelash. It is particularly important to achieve sufficient adhesion of the ends of the artificial eyelash to the corners of the eyelid because this is the area in which the artificial eyelash will lift if not properly applied.

There are several drawbacks associated with existing techniques for applying an artificial eyelash. In particular, the location of the user's hands, fingers and/or the applicator device proximate the wearer's eye during application of the artificial eyelash obstructs the user's view in a mirror of the area to which the artificial eyelash is to be applied, thereby making placement difficult.

Moreover, in existing application techniques, the adhesive used to secure the artificial eyelash to the user's eyelid can adhere to the user's fingers and/or to the applicator device, requiring excessive handling of the artificial eyelash and causing unwanted distortion and bending of the artificial eyelash. Existing applicator devices also do not adequately allow for effective application of the artificial eyelash on different eye shapes. For example, the rigid plastic clamshell-style applicators lock the artificial eyelash in a preset curvature.

Accordingly, a need exists for an artificial eyelash, an artificial eyelash assembly and a method for applying an artificial eyelash which allows a user's hands and/or fingers to be positioned away from the application area, thereby providing an unobstructed view and allowing for more accurate placement. A need also exists for an artificial eyelash, an artificial eyelash assembly and a method for applying an artificial eyelash which eliminates or minimizes unwanted adhesion to a user's fingers or to the applicator device. A need also exists for an artificial eyelash, an artificial eyelash assembly and a method for applying an artificial eyelash which allows a user to easily and readily achieve a selected tension and placement position of the artificial eyelash on various eye shapes.

SUMMARY OF THE INVENTION

An artificial eyelash, an artificial eyelash assembly and a method for applying an artificial eyelash are provided.

In one aspect, a method for applying an artificial eyelash to an eyelid includes the steps of providing an artificial eyelash having a base strand and a plurality of hairs. A first flexible member is secured to the artificial eyelash proximate a first end of the base strand and a second flexible member is secured to the artificial eyelash proximate a second end of the base strand. The first and second flexible members are grasped and a selected degree of tension is imparted on the artificial eyelash. The artificial eyelash is manipulated into a selected position on the eyelid using the first and second flexible members. The artificial eyelash is secured to the eyelid with an adhesive material and the first flexible member and second flexible member are removed from the artificial eyelash.

In a further aspect of the method, the first flexible member is threaded through a first loop provided proximate the first end and the second flexible member is threaded through a second loop provided proximate the second end.

In a further aspect of the method, the first flexible member is slid through the first loop and the second flexible member is slid through the second loop.

In a further aspect of the method, a first clip is closed on the artificial eyelash proximate the first end of the base strand and a second clip is closed on the artificial eyelash proximate the second end of the base strand. In a further aspect of the method, the first clip and second clip are opened.

In another aspect, an artificial eyelash includes a base strand having a first end and a second end opposite the first end and a plurality of hairs. A first loop is disposed proximate the first end of the base strand and a second loop is disposed proximate the second end of the base strand.

In a further aspect, the artificial eyelash includes an adhesive material for securing the artificial eyelash to an eyelid.

In a further aspect, the first loop and second loop have substantially a same color as the plurality of hairs.

In another aspect, an artificial eyelash assembly includes a base strand having a first end and a second end opposite the first end and a plurality of hairs. A first loop is disposed proximate the first end of the base strand and a second loop is disposed proximate the second end of the base strand. A first flexible member is coupled to the first loop and a second flexible member is coupled to the second loop.

In a further aspect, the artificial eyelash assembly includes an adhesive material for securing the artificial eyelash to an eyelid.

In a further aspect, the first flexible member and second flexible member each include a length of string. In a further aspect, the first flexible member and second flexible member each include a transparent or translucent material.

In a further aspect, the first flexible member and second flexible member each include a non-stick surface. In a further aspect, the first flexible member and second flexible member each include a silicon treated string.

In another aspect, an artificial eyelash assembly includes a base strand having a first end and a second end opposite the first end and a plurality of hairs. A first flexible member is coupled proximate the first end and a second flexible member is coupled proximate the second end.

In a further aspect, the artificial eyelash assembly includes an adhesive material for securing the artificial eyelash to an eyelid.

In a further aspect, the artificial eyelash assembly further includes a first clip secured to the first flexible member and a second clip secured to the second flexible member. In a further aspect, the first clip includes a first opening for receiving the first flexible member and a first gripping portion for gripping the first end of the base strand and the second clip includes a second opening for receiving the second flexible member and a second gripping portion for gripping the second end of the base strand.

In a further aspect, each of the first clip and the second clip include a snapping clip movable between a closed position for gripping the base strand and an open position for releasing the base strand.

An advantage of an artificial eyelash, an artificial eyelash assembly and/or a method for applying an artificial eyelash according to an aspect of the invention is that a user's hands and/or fingers are positioned away from the application area, thereby providing an unobstructed view and allowing for more accurate placement. Another advantage of an artificial eyelash, an artificial eyelash assembly and/or a method for applying an artificial eyelash according to an aspect of the invention is that unwanted adhesion to a user's fingers or to the applicator device is eliminated or minimized. Another advantage of an artificial eyelash, an artificial eyelash assembly and/or a method for applying an artificial eyelash according to an aspect of the invention is that a user can easily and readily achieve a selected tension and placement position of the artificial eyelash on various eye shapes.

BRIEF DESCRIPTION OF THE DRAWINGS

Other benefits and features of the present invention will become apparent from the following detailed description considered in connection with the accompanying drawings. It is to be understood, however, that the drawings are designed as an illustration only and not as a definition of the limits of the invention.

In the drawings, wherein similar reference characters denote similar elements throughout the several views.

DETAILED DESCRIPTION OF THE DRAWINGS

As set forth above, effective application of an artificial eyelash to an eyelid requires the proper degree of tension and curvature, as well as accurate placement of the artificial eyelash. It is particularly important to achieve sufficient adhesion of the ends of the artificial eyelash to the corners of the eyelid because this is the area in which the artificial eyelash will lift if not properly applied.

Moreover, persons who wear artificial eyelashes may have substantially different eye shapes. For example, FIG. 1 shows an exemplary pair of eyes having a round shape, FIG. 2 shows an exemplary pair of eyes having an oval shape and FIG. 3 shows an exemplary pair of eyes having an almond shape.

Figure 1:
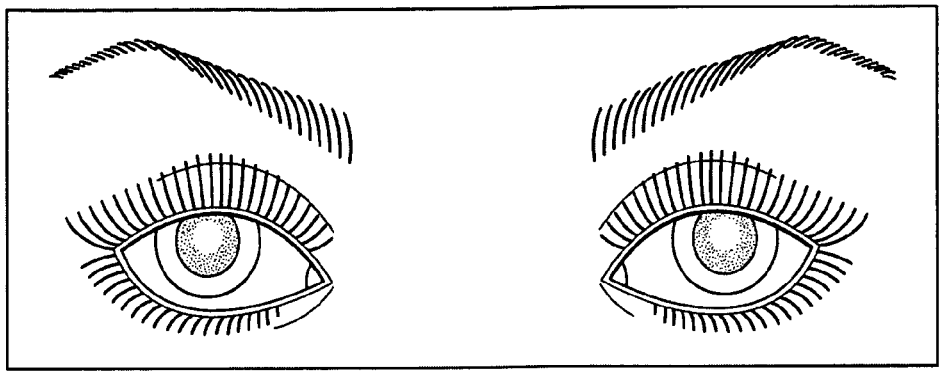
FIG. 1 shows an exemplary pair of eyes having a round shape.
Figure 2:
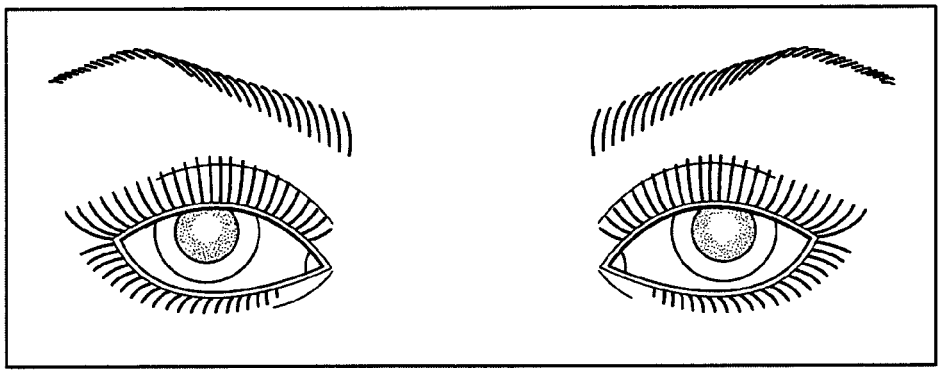
FIG. 2 shows an exemplary pair of eyes having an oval shape.
Figure 3:
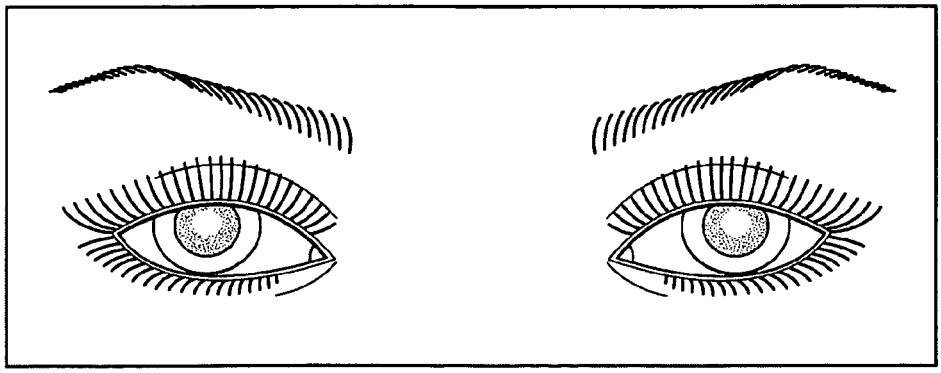
FIG. 3 shows an exemplary pair of eyes having an almond shape.

A method for applying an artificial eyelash, an artificial eyelash and an artificial eyelash assembly according to embodiments of the invention provide for effective application of the artificial eyelash on different eye shapes, including those exemplified in FIGS. 1-3 and variations thereof.

Figure 4A:
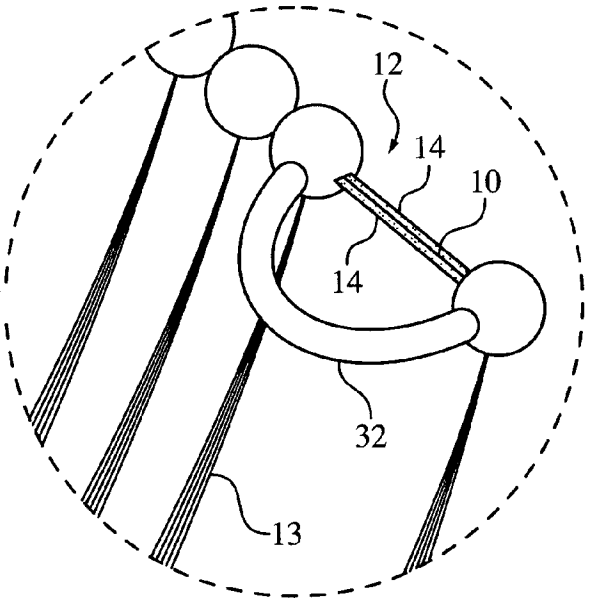
FIG. 4A shows a detailed view of an end of the artificial eyelash shown in FIG. 4.
Figure 4:
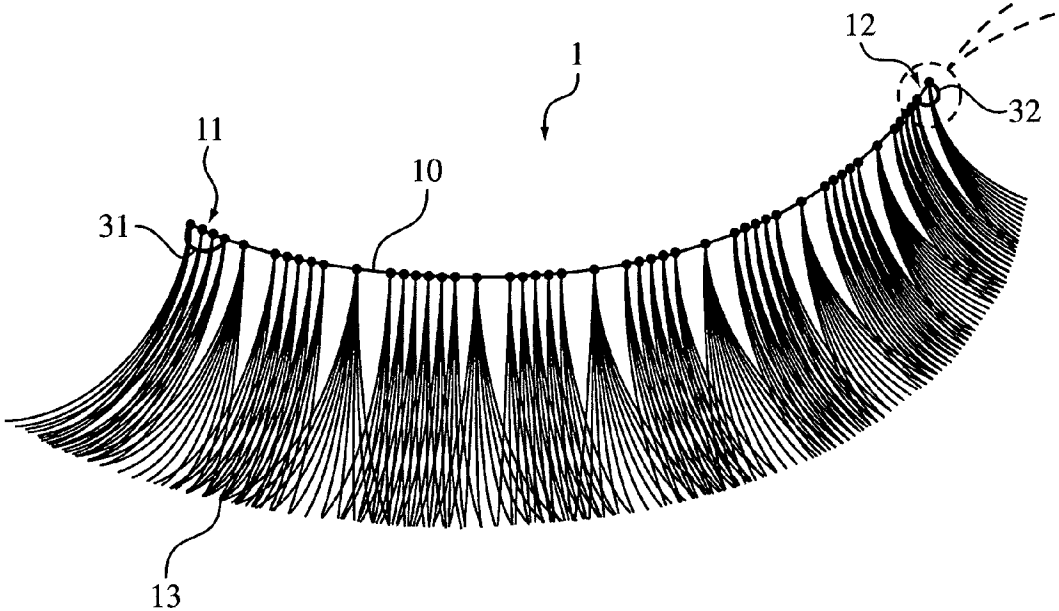
FIG. 4 shows an artificial eyelash according to an embodiment of the invention.

FIG. 4 shows an artificial eyelash according to an embodiment of the invention. Artificial eyelash 1 has a base strand 10 having a first end 11 and a second end 12 opposite first end 11. A plurality of hairs 13 are coupled to the base strand 10. The hairs 13 preferably have a curved profile simulating the appearance of an actual human eyelash. The phrase "artificial eyelash" as used herein refers to an apparatus which is not part of the wearer's body. The artificial eyelash 1, including the base strand 10 and/or the plurality of hairs 13, may be formed from, for example human hair, animal hair or synthetic fibers, or a combination thereof.

FIG. 4A shows a detailed view of second end 12 of artificial eyelash 1. Artificial eyelash 1 includes an adhesive material 14 for securing the artificial eyelash 1 to an eyelid or in close proximity to an eyelid. Adhesive material 14 (not shown to scale) may be, for example, a latex based adhesive or any other adhesive material compatible with the material of the artificial eyelash 1 and suitable for adhering the artificial eyelash to an eyelid or in close proximity thereto. Artificial eyelash 1 may be provided with adhesive material 14 pre-applied. Alternatively, a user may apply the adhesive material 14 to the artificial eyelash 1. Adhesive material 14 is preferably provided on or applied by the user to an entire length or substantially the entire length of base strand 10. For example, the artificial eyelash may be dipped in the adhesive material 14 or the adhesive material 14 applied to the artificial eyelash with an applicator, such as an applicator bottle, tube, brush, toothpick, tweezers or the like.

A first loop 31 is disposed proximate first end 11 of base strand 10 and a second loop 32 is disposed proximate second end 12 of base strand 10. First loop 31 and second loop 32 may extend out from base strand 10 or hairs 13 and turn back, forming a closed loop. Loops 31 and 32 may be incorporated into the artificial eyelash during the manufacturing process and may be formed from the same material as base strand 10 and/or plurality of hairs 13 or from a different material.

First loop 31 and second loop 32 may be the same color or substantially the same color as the plurality of hairs 13. For example, first loop 31, second loop 32 and plurality of hairs 13 may all be a shade of black. Additionally, first loop 31 and second loop 32 may comprise a thin material and have a small dimension, such that loops 31, 32 are nearly invisible to the naked eye. In this way, loops 31, 32 blend in to the artificial eyelash 1 and do not detract from its appearance or make the artificial eyelash appear unnatural.

First loop 31 and second loop 32 are disposed proximate the respective first 11 and second 12 ends of base strand 10. The phrase "proximate" contemplates that the loops 31, 32 are located at or near the respective ends of the base strand 10. For example, loops 31, 32 may be positioned at the end of base strand 10 or alternatively at a distance from the ends sufficient to allow the ends of the artificial eyelash to be trimmed to length to fit a particular user's natural lash line without trimming off the portion including the loop. It is contemplated that loops 31, 32 would typically be disposed at a distance of approximately zero to seven millimeters from a respective end of the artificial eyelash 1. For example, loops 31, 32 may be disposed at a distance of approximately five millimeters from a respective end of the artificial eyelash 1 to allow for trimming of the artificial eyelash to size. Larger distances from an end of the artificial eyelash are also possible, depending on the nature of the artificial eyelash style and/or the wearer's particular requirements, including, for example, the size of the wearer's natural lash line.

Figure 5:
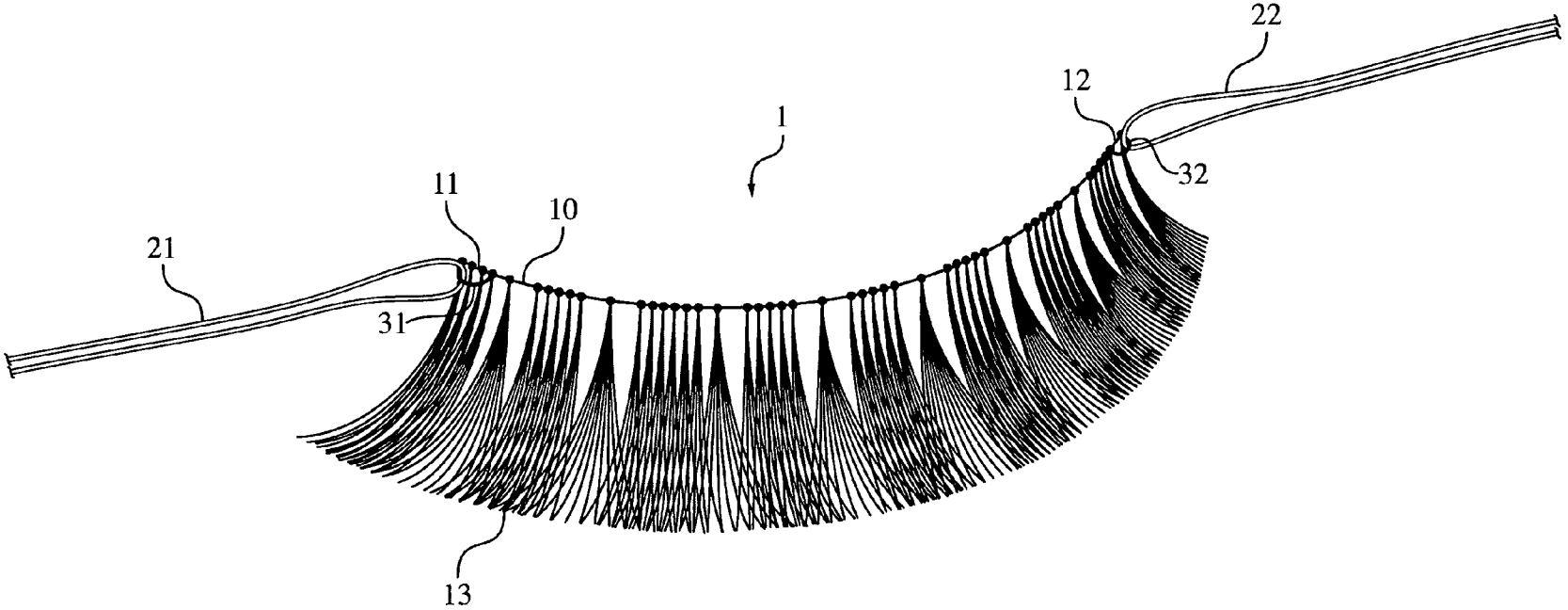
FIG. 5 shows an artificial eyelash assembly according to an embodiment of the invention.

As shown in FIG. 5, an artificial eyelash assembly according to an embodiment of the invention may further include a first flexible member 21 coupled to first loop 31 and a second flexible member 22 coupled to second loop 32. The flexible members 21, 22 are preferably elongated lengths of string, cord, fiber or similar material. The flexible members 21, 22 may be made from a transparent or translucent material. This feature may enhance visibility of the artificial eyelash 1 as it is manipulated into a selected position during application. The first and second flexible members 21, 22 may include a non-stick surface for preventing the adhesive material 14 from adhering to the flexible members 21, 22. The non-stick surface may also allow the flexible members 21, 22 to easily slide in and out of the respective loops 31, 32. For example, flexible members 21, 22 may include lengths of silicone or silicone treated string.

Figure 6:
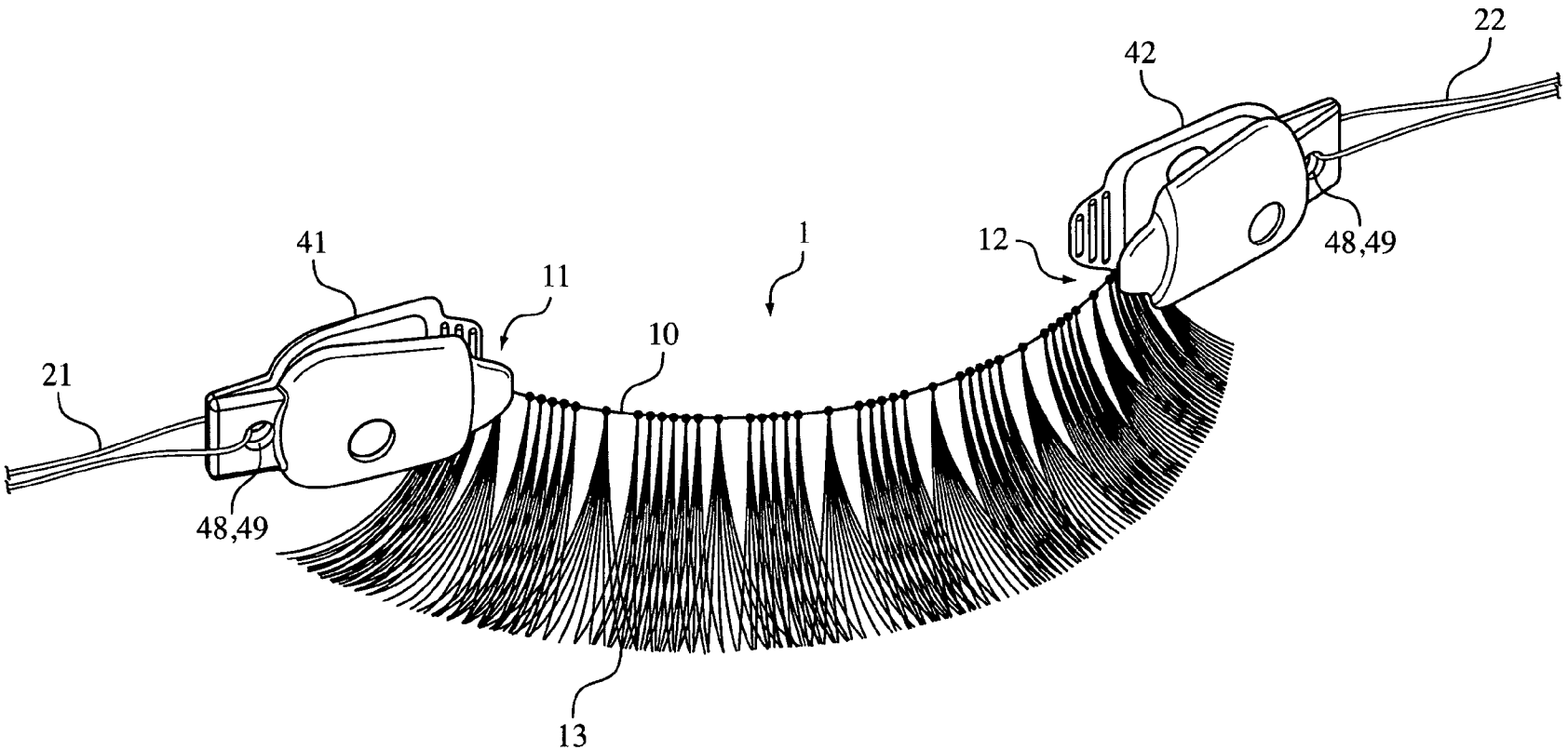
FIG. 6 shows an artificial eyelash assembly according to another embodiment of the invention with a pair of clips in an open position.
Figure 7:
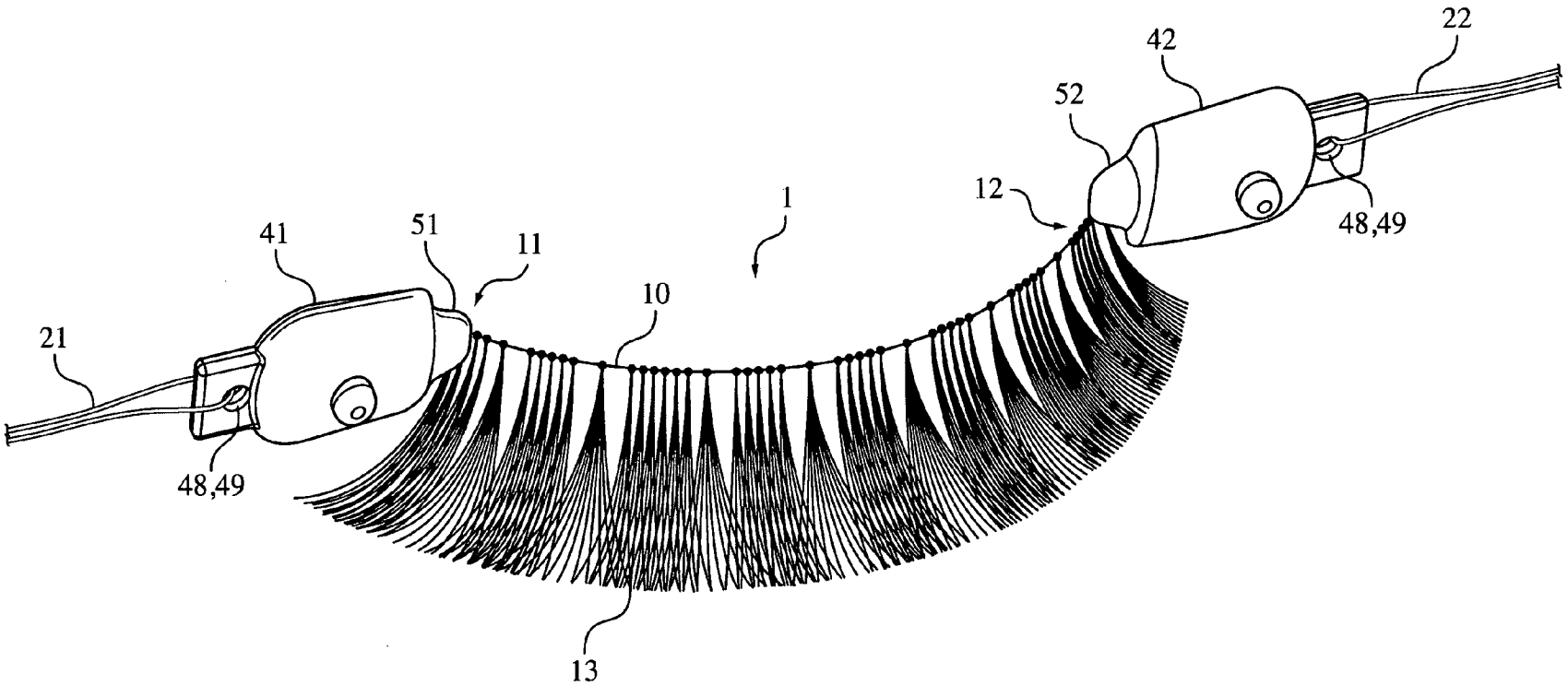
FIG. 7 shows the artificial eyelash assembly as shown in FIG. 6 with the pair of clips in a closed position for gripping the respective ends of the artificial eyelash.
Figure 8:
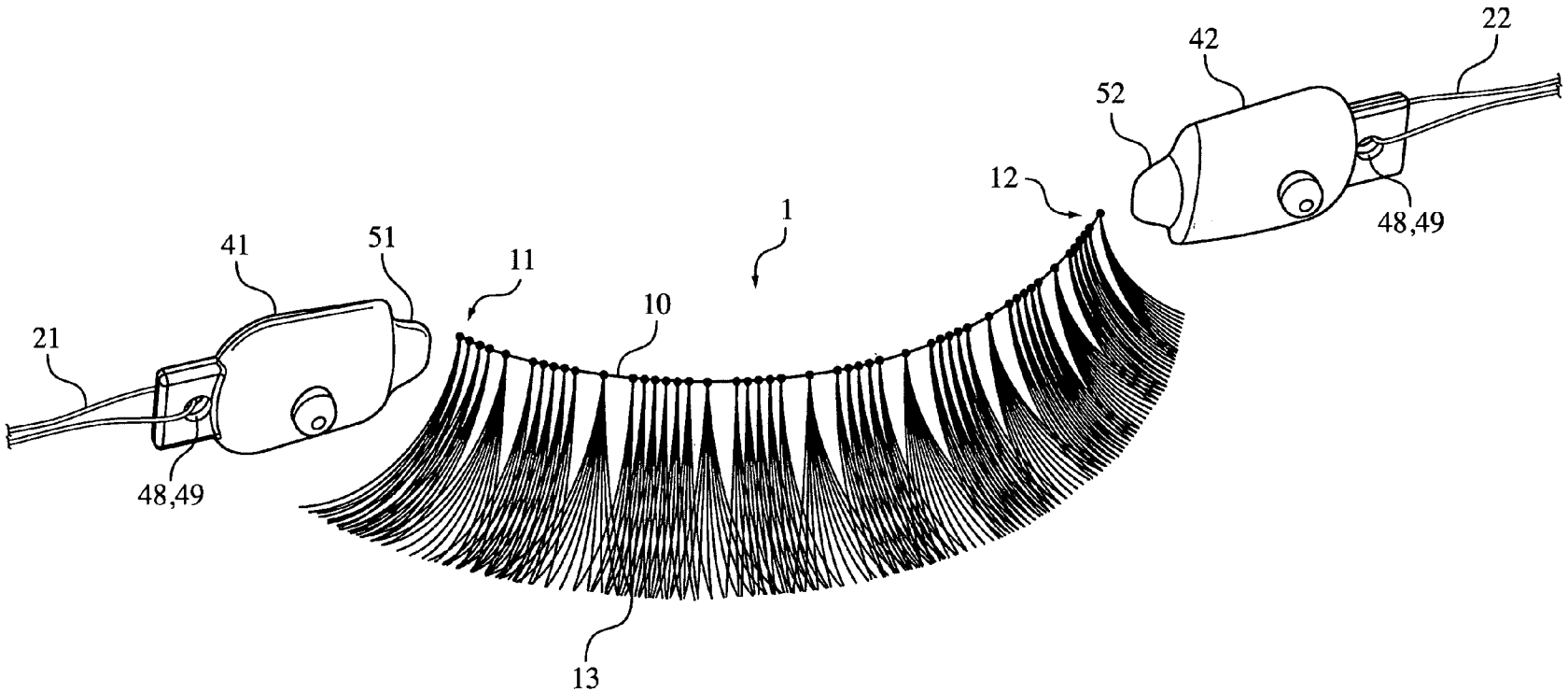
FIG. 8 shows the artificial eyelash assembly as shown in FIG. 6 with the artificial eyelash released from the pair of clips.

FIGS. 6, 7 and 8 show an artificial eyelash assembly according to another embodiment of the invention. As shown artificial eyelash 1 includes a base strand 10 having a first end 11 and a second end 12 opposite first end 11. A plurality of hairs 13 are coupled to base strand 10. An adhesive material (as shown, for example in FIG. 4A) may be provided for securing the artificial eyelash 1 to an eyelid. A first flexible member 21 is coupled proximate the first end 11 and a second flexible member 22 is coupled proximate the second end 12. The foregoing features may be as previously described for the embodiment shown in FIGS. 4, 4A and 5.

The artificial eyelash assembly further has a first clip 41 secured to first flexible member 21 and a second clip 42 secured to second flexible member 22. As shown in FIGS. 9-12, each of first and second clips may be in the form of a snapping or snap-on clip having an extended tab or gripping portion for gripping an end 11, 12 of the base strand 10 of artificial eyelash 1.

Clips 41, 42 may be an injection molded part and may have an upper part 43 and a lower part 44 connected in a hinged manner. Upper part 43 may include an upper gripping part 45 and lower part 44 may include a lower gripping part 46. Upper and lower gripping parts 45, 46 combine when the clip is in a closed position to provide first gripping portion 51 of first clip 41 and second gripping portion 52 of second clip 42. First and second gripping portions 51, 52 may be in the form of extended tabs approximately seven millimeters in length and four millimeters wide. These dimensions are exemplary only and larger or smaller dimensions of the gripping portions are possible.

As shown, for example in FIG. 7, in a closed or locked position, first clip 41 grips a first end portion 11 of base strand 10 with first gripping portion 51 and second clip 42 grips a second end portion 12 of base strand 10 with second gripping portion 52. As shown, for example in FIG. 6, first clip 41 and second clip 42 can be snapped or moved to an open or unlocked position for releasing the base strand 10. Thus, each of the first clip 41 and second clip 42 is movable between a closed position for gripping the base strand 10 and an open position for releasing the base strand 10.

Figure 9:
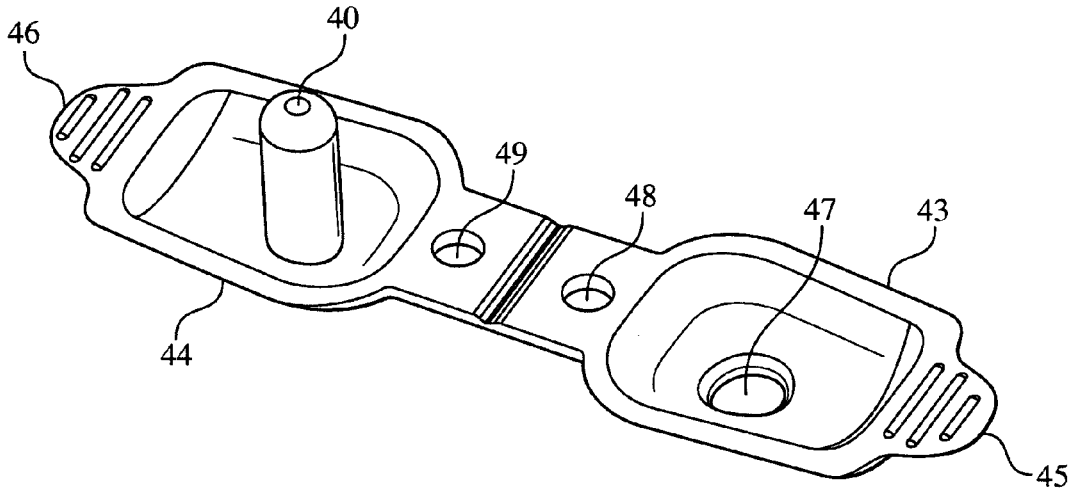
FIG. 9 shows a clip for an artificial eyelash assembly according to an embodiment of the invention.
Figure 10:
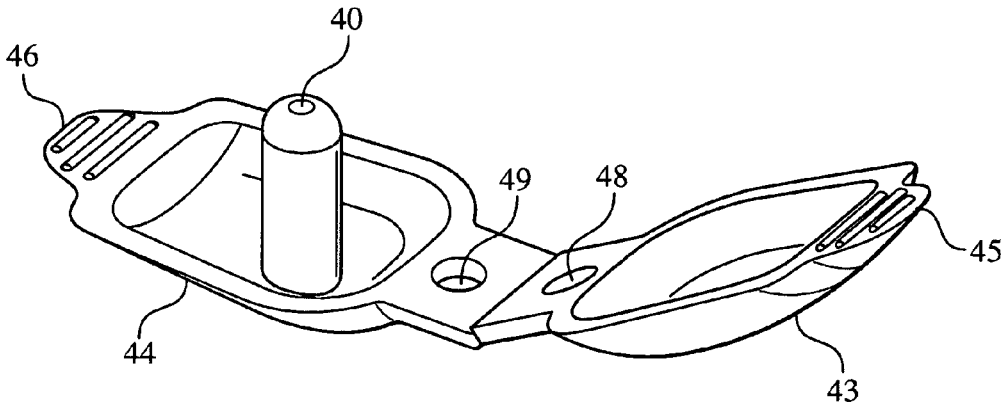
FIG. 10 shows the clip shown in FIG. 9 being pivoted.
Figure 11:
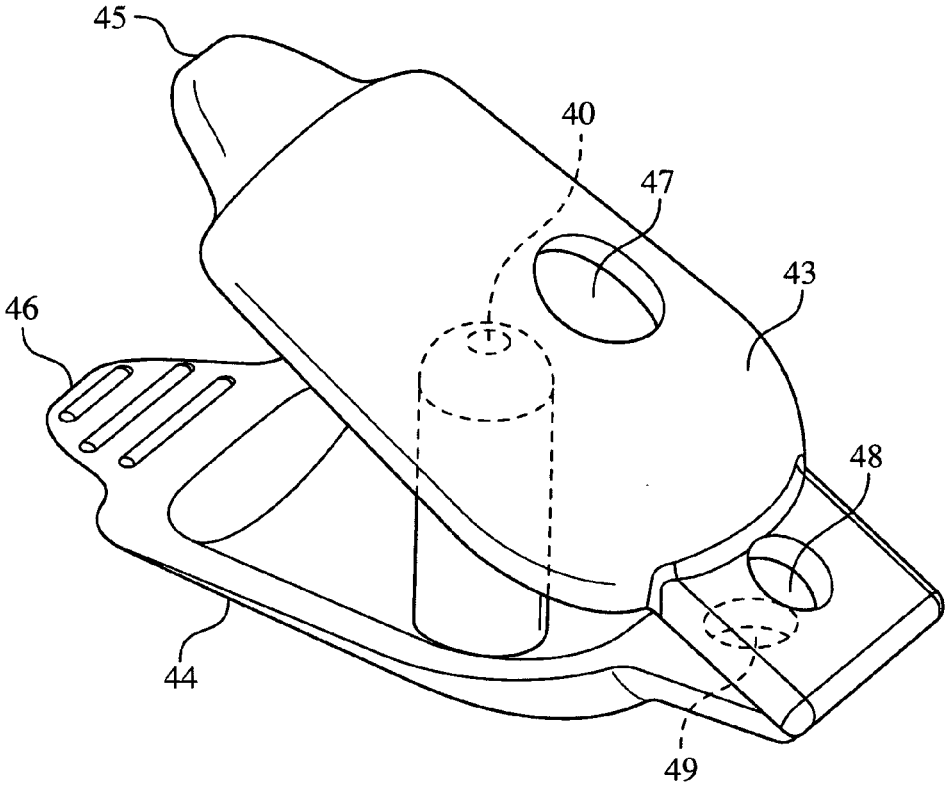
FIG. 11 shows the clip shown in FIGS. 9 and 10 in an open position.

First and second clips 41, 42 may also include respective first and second openings (48, 49) for receiving the respective first and second flexible members 21, 22. As shown in FIGS. 9-11, the first and second openings may be formed by an upper opening 48 in upper part 43 and a lower opening 49 in lower part 44. The openings 48,49 are dimensioned so that flexible members 21, 22 may be threaded through the respective openings for securing to the clips 41, 42.

Figure 12:
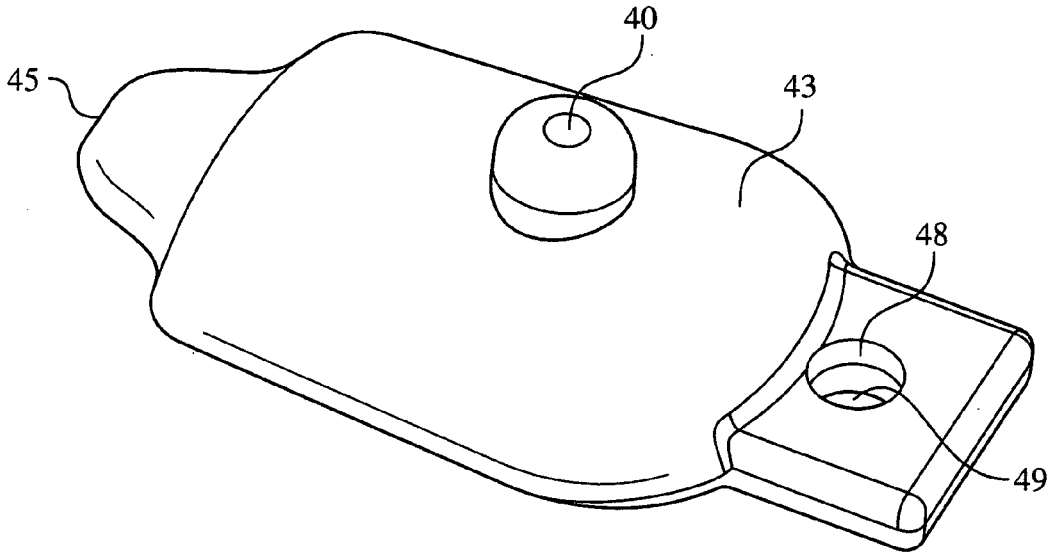
FIG. 12 shows the clip shown in FIGS. 9, 10 and 11 in a closed position.

First and second clips 41, 42 may also include a column or post 40. As shown in FIGS. 9-12, column 40 may extend upwardly from lower part 44 of the clip and engage a corresponding opening 47 provided in the upper part 43 of the clip. The interaction of column 40 and opening 47 may assist in securing the clip in its closed position for gripping the base strand 10 of the artificial eyelash 1. As shown in FIG. 12, column 40 may project through opening 47 when the clip is in its closed or locked position. A user may easily open the clip by pressing on column 40 with a thumb or finger and at the same time holding or pulling on a portion of upper part 43 of the clip, such as, for example, upper gripping part 45.

A method for applying an artificial eyelash 1 to an eyelid according to an embodiment of the invention includes the steps of providing an artificial eyelash 1 having a base strand 10 and a plurality of hairs 13. A first flexible member 21 is secured to the artificial eyelash 1 proximate a first end 11 of the base strand 12 and a second flexible member 22 is secured to the artificial eyelash 1 proximate a second end 12 of the base strand.

The first and second flexible members 21, 22 may be elongated lengths of string, cord, fiber or similar material and may be made from a transparent or translucent material, having a non-stick surface.

The first and second flexible members 21, 22 may be secured to the artificial eyelash 1, for example by threading the first flexible member 21 through a first loop 31 provided proximate the first end 11 and threading the second flexible member 22 through a second loop 32 provided proximate the second end 12. The first and second flexible members 21, 22 may be also secured to the artificial eyelash 1, for example by closing a first clip 41 on the artificial eyelash 1 proximate the first end 11 of the base strand 10 and closing a second clip 42 on the artificial eyelash 1 proximate the second end 12 of the base strand 10. First and second clips 41, 42 are coupled to the respective first and second flexible members 21, 22.

A user grasps the first and second flexible members 41, 42 and imparts a selected degree of tension on the artificial eyelash 1. The user manipulates the artificial eyelash 1 into a selected position on the eyelid using the first and second flexible members 21, 22. The elongated arrangement of the first and second flexible members 21, 22 allows the user to manipulate the artificial eyelash with his or her fingers and hands positioned away from the application area, thereby providing enhanced visibility and facilitating the accurate positioning of the artificial eyelash 1.

The user secures the artificial eyelash 1 to the eyelid with an adhesive material 14, which typically has been previously applied to the base strand 10 of the artificial eyelash 1. The first and second flexible members 21, 22 are then removed from the artificial eyelash 1. For example, the first and second flexible members 21, 22 may be slid through the respective first and second loops 31, 32. This process may be facilitated by providing the flexible members with a non-slip surface, for example, the first and second flexible members may be formed from a silicone or silicone-treated string. The first and second members 21, 22 may also be removed by opening or unlocking the respective first and second clip 41, 42.

Although several embodiments of the present invention have been shown and described, it is obvious that many changes and modifications may be made thereunto without departing from the spirit and scope of the invention.

What is claimed is:

1. An artificial eyelash assembly comprising:

a) a base strand having a first end, a second end opposite the first end, and an application area between the first end and the second end for application to an eyelid of a user;

b) a plurality of hairs coupled to the base strand;

c) a first loop disposed proximate the first end of the base strand d) a second loop disposed proximate the second end of the base strand;

e) a first flexible member removably coupled to the first loop and extending away from the application area of the base strand; and f) a second flexible member removably coupled to the second loop and extending away from the application area of the base strand;

wherein the first and second flexible members allow for manipulation of the base strand by the user during the application, and are removable from the first loop and the second loop, respectively, after the application.

2. The artificial eyelash assembly according to claim 1, further comprising an adhesive material for securing the artificial eyelash to the eyelid.

3. The artificial eyelash assembly according to claim 1, wherein the first flexible member and the second flexible member each comprise a length of string.

4. The artificial eyelash assembly according to claim 1, wherein the first flexible member and the second flexible member each comprise a transparent material.

5. The artificial eyelash assembly according to claim 1, wherein the first flexible member and the second flexible member each comprise a translucent material.

6. The artificial eyelash assembly according to claim 1, wherein the first flexible member and the second flexible member each comprise a non-stick surface.

7. The artificial eyelash assembly according to claim 6, wherein the first flexible member and the second flexible member each comprise a silicon treated string.

* * * * *